US011041264B2

(12) United States Patent
Barney et al.

(10) Patent No.: US 11,041,264 B2
(45) Date of Patent: Jun. 22, 2021

(54) STITCHING SYSTEM FOR A SHOE UPPER

(71) Applicant: NIKE, Inc., Beaverton, OR (US)

(72) Inventors: Bruce Alan Barney, Portland, OR (US); Kassio Figur, Portland, OR (US); Jessica Anne Junkins, Portland, OR (US); Sara Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 42 days.

(21) Appl. No.: 16/424,097

(22) Filed: May 28, 2019

(65) Prior Publication Data

US 2019/0365053 A1 Dec. 5, 2019

Related U.S. Application Data

(60) Provisional application No. 62/678,683, filed on May 31, 2018.

(51) Int. Cl.

| | |
|---|---|
| ***D05B 31/00*** | (2006.01) |
| ***A43D 11/00*** | (2006.01) |
| *A43B 23/02* | (2006.01) |

(52) U.S. Cl.

CPC ..... *D05B 31/00* (2013.01); *A43D 11/00* (2013.01); *A43B 23/0245* (2013.01); *D10B 2501/043* (2013.01)

(58) Field of Classification Search

CPC ..... D05B 31/00; D05B 31/02; A43D 11/00; A43D 11/01; A43D 11/02; A43D 11/12

USPC ..... 112/29, 28, 470.14, 470.16, 470.25

See application file for complete search history.

(56) References Cited

U.S. PATENT DOCUMENTS

| | | | | |
|---|---|---|---|---|
| 1,774,620 A * | 9/1930 | Topham | ..... | A43B 23/0295 12/146 C |
| 3,988,993 A * | 11/1976 | Brophy | ..... | D05B 31/00 112/470.07 |
| 4,171,672 A * | 10/1979 | Dorosz | ..... | D05B 39/00 112/470.18 |

(Continued)

FOREIGN PATENT DOCUMENTS

| | | |
|---|---|---|
| CN | 206635512 U | 11/2017 |
| KR | 101852877 BI | 4/2018 |

OTHER PUBLICATIONS

International Search Report and Written Opinion dated Oct. 15, 2019 in International Patent Application No. PCT/US2019/034413, 15 pages.

(Continued)

*Primary Examiner* — Danny Worrell

(74) *Attorney, Agent, or Firm* — Shook, Hardy & Bacon L.L.P.

(57) ABSTRACT

A system for stitching two parts of a shoe together includes a stitching machine with a head and a cylinder bed. The head has a needle base disposed on a lower end adjacent the cylinder bed such that the two shoe parts can be stitched together therebetween. A positioning mechanism has a curved drive frame and is capable of moving the curved drive frame in a rotating motion along the circumference of the curved drive frame and in a linear direction generally along an axis of the curved drive frame. A jig positions the two shoe parts with respect to one another and is coupled to the curved drive frame. The jig includes a curved support surface for supporting the two shoe parts.

18 Claims, 11 Drawing Sheets

(56) References Cited

U.S. PATENT DOCUMENTS

| | | | | |
|---|---|---|---|---|
| 4,510,876 | A * | 4/1985 | Garley | D05B 39/00 112/121 |
| 4,593,634 | A * | 6/1986 | Moreno | D05B 31/00 112/470.06 |
| 4,607,741 | A | 8/1986 | Elliott et al. | |
| 4,694,766 | A * | 9/1987 | Wickers | D05B 31/00 112/470.14 |
| 4,998,964 | A * | 3/1991 | Golia | D05B 21/00 112/102.5 |
| 5,421,277 | A * | 6/1995 | Conley, Jr. | D05B 39/00 112/102.5 |
| 5,553,560 | A * | 9/1996 | Tajima | D05B 21/00 112/103 |
| 8,429,835 | B2 * | 4/2013 | Dojan | A43B 5/00 36/3 A |
| 10,508,385 | B2 * | 12/2019 | Kuo | B23K 26/38 |
| 2007/0034127 | A1 * | 2/2007 | Okamoto | D05C 9/04 112/2 |
| 2017/0273405 | A1 | 9/2017 | Kilgore | |
| 2019/0352823 | A1 * | 11/2019 | Tachikawa | D05B 31/00 |
| 2019/0365053 | A1 * | 12/2019 | Barney | A43D 11/01 |
| 2019/0368092 | A1 * | 12/2019 | Kilgore | D05B 31/02 |

OTHER PUBLICATIONS

International Preliminary Report on Patentability received for PCT Patent Application No. PCT/US2019/034413, dated Dec. 10, 2020, 9 pages.

* cited by examiner

STITCHING SYSTEM FOR A SHOE UPPER

RELATED

This application claims the benefit of priority of U.S. Application No. 62/678,683, titled "Stitching System for a Shoe Upper," and filed May 31, 2018. The entirety of the aforementioned application is incorporated by reference herein.

TECHNICAL FIELD

Aspects hereof relate to apparatuses, systems and methods for automated stitching of components/parts of a shoe upper to be incorporated into articles of footwear, e.g., shoes. More particularly, aspects relate to apparatuses, systems and methods for automatically stitching two shoe upper parts together to form a portion of a shoe upper.

BACKGROUND

Articles of footwear and, in particular, shoes may be made by combining components, such as uppers and bottom units (comprising a midsole and an outsole), which may themselves be comprised of subcomponents. For instance, a shoe upper may be comprised of multiple planar parts that are cut from different stock pieces of material, for example, but not limited to, an exterior upper and a heel liner. The exterior upper may be made of a material that is more wear resistant and the heel liner may be made of a material that is more comfortable to the foot of a wearer. These shoe parts are then stitched together utilizing a manual stitching machine. The shoe upper parts, such as the exterior upper and the heel liner, are required to be skillfully manipulated by a worker to form the seams of a resulting upper.

BRIEF SUMMARY

Aspects hereof provide a system for stitching two parts of a shoe together including a stitching machine having a head and a cylinder bed. The head has a needle base disposed on a lower end adjacent the cylinder bed such that the two shoe parts can be stitched together therebetween. The system further includes a positioning mechanism having a curved drive frame coupled thereto. The positioning mechanism is capable of moving the curved drive frame in a rotating motion along the circumference of the curved drive frame and in a linear direction generally along an axis of the curved drive frame. The system further includes a jig for positioning the two shoe parts with respect to one another and that is coupled to the curved drive frame. The jig includes a curved support surface for the two shoe parts. The system also includes a computing device for controlling actuation of the needle bed and the positioning mechanism such that the jig can be manipulated to provide a specific stitch arrangement for connecting the two shoe parts.

Another aspect hereof includes a jig for stitching two shoe parts together on an embroidery machine. The jig includes a curved mounting member capable of being coupled to the embroidery machine. The jig also includes a curved support surface coupled to the mounting member and capable of supporting the two shoe parts as they are joined together. The curved support surface includes an edge positioned at a location distal from the mounting member and that has the general shape of the stitch line to be formed between the two shoe parts.

A further aspect includes a method of joining two shoe parts together in a specific fashion. The method includes providing an embroidery machine with a hat hoop positioning mechanism and securing the two shoe parts to a curved jig. The method also includes securing the curved jig to the hat hoop positioning mechanism and accessing a pattern from a computing device of the embroidery machine. The pattern represents the stitch line for joining the two shoe parts together. The method also includes joining the two shoe parts together based upon the pattern.

DESCRIPTION OF THE DRAWINGS

The present invention is described in detail herein with reference to the attached drawing figures, wherein.

DETAILED DESCRIPTION

Figure 1:
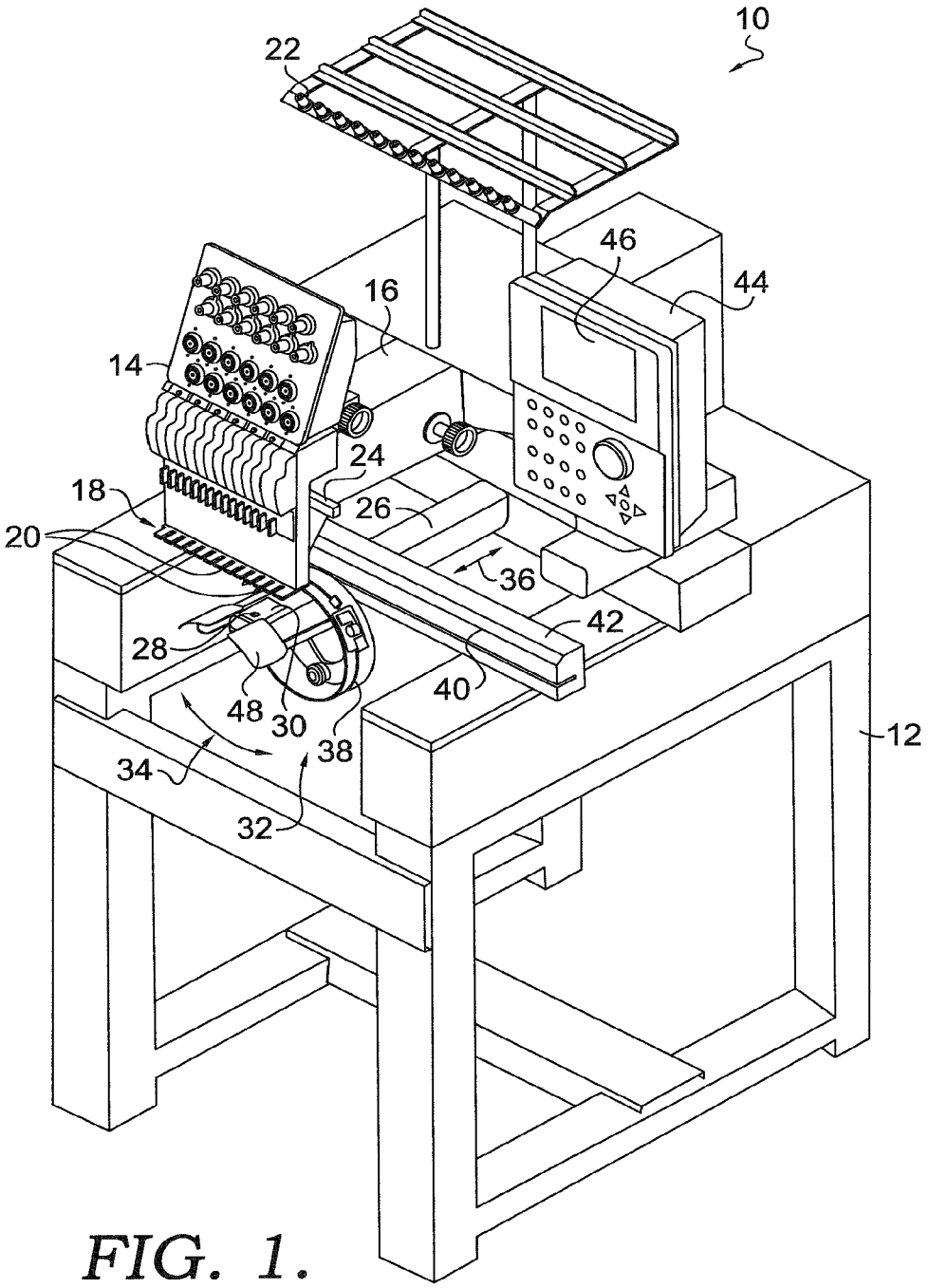
FIG. 1 depicts a top perspective view of a known embroidery machine with a hat hoop positioning mechanism.
Figure 2:
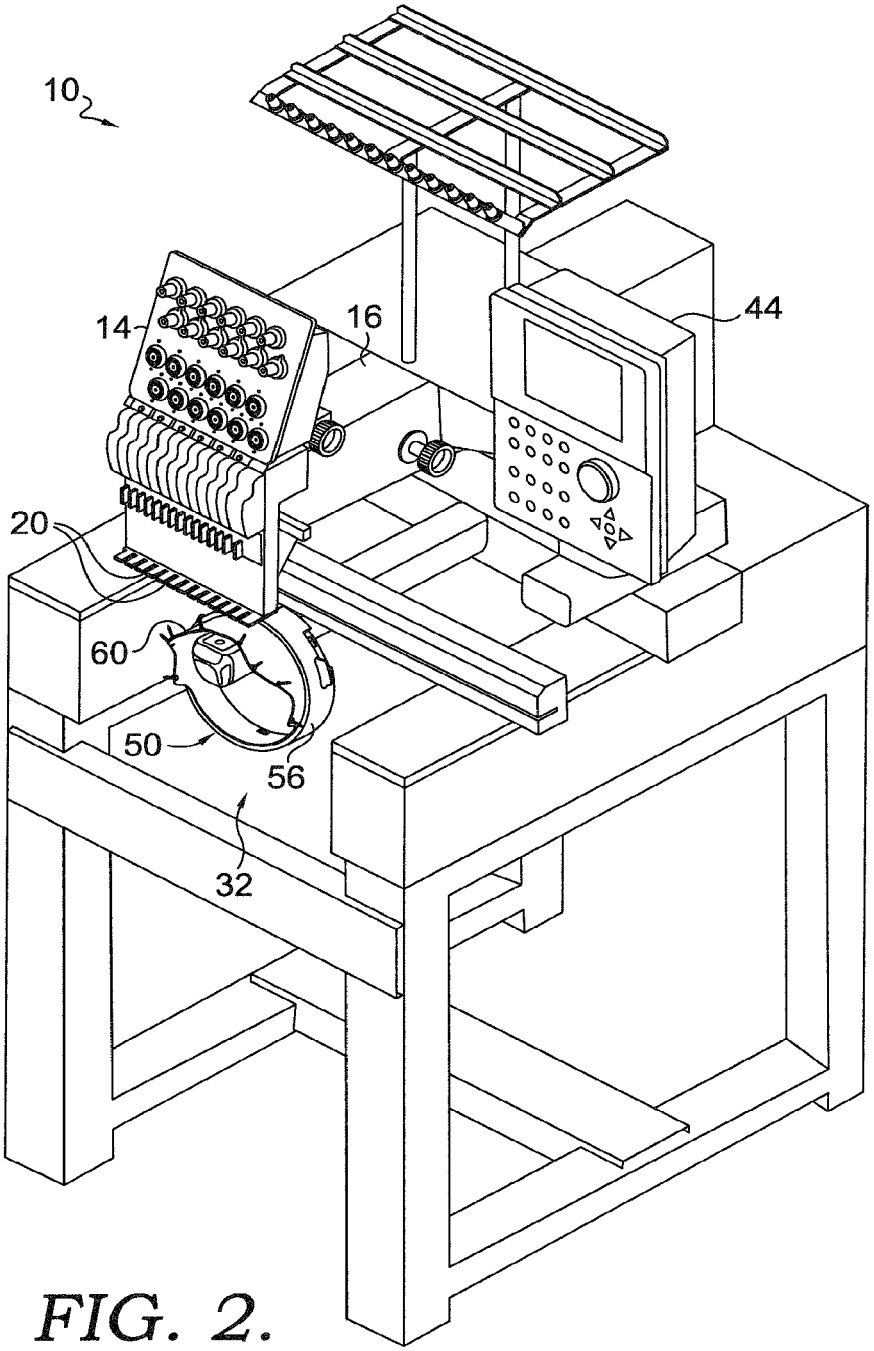
FIG. 2 depicts a top perspective view of a system capable of automatically stitching two shoe parts together including a support jig coupled to the hat hoop positioning mechanism, in accordance with exemplary aspects hereof.

As a result of the desires for protection and support from an upper, cushioning from a midsole, and traction and durability from an outsole, a given shoe may utilize diverse materials and structural designs for these different components. Further, additional components that provide, for example, particularized impact protection, motion control for pronation or supination, varying degrees of support, additional impact protection, and the like may further complicate the design of all or part of a shoe. Nevertheless, these components must be ultimately integrated to form a wearable shoe that is both functional and, ideally, attractive. Shoes may be made by combining components, such as uppers and bottom units (comprising a midsole and an outsole), which may themselves be comprised of subcomponents. For instance, a shoe upper may be comprised of multiple planar parts that are cut from different stock pieces of material, for example, but not limited to, an exterior upper and a heel liner. The exterior upper may be made of a material that is more wear resistant and the heel liner may be made of a material that is more comfortable to the foot of a wearer. These shoe parts are then stitched together utilizing a manual stitching machine. The shoe upper parts, such as the exterior upper and the heel liner, are required to be skillfully manipulated by a worker to form the seams of a resulting upper. This manual stitching operation is very labor intensive and creates great inefficiencies in the manufacturing of shoes. Additionally, because each worker may stitch in a different manner, this type of manual manufacturing may also create inconsistencies between shoes of the same model and type. These inconsistencies may be visually perceptible to a buyer and can also result in rejected shoes as part of the inspection process.

Aspects hereof provide a system for stitching two parts of a shoe together including a stitching machine having a head and a cylinder bed. The head has a needle base disposed on a lower end adjacent the cylinder bed such that the two shoe parts can be stitched together therebetween. The system further includes a positioning mechanism having a curved drive frame coupled thereto. The positioning mechanism is capable of moving the curved drive frame in a rotating motion along the circumference of the curved drive frame and in a linear direction generally along an axis of the curved drive frame. The system further includes a jig for positioning the two shoe parts with respect to one another and that is coupled to the curved drive frame. The jig includes a curved support surface for two shoe parts. The system also includes a computing device for controlling actuation of the needle bed and the positioning mechanism such that the jig can be manipulated to provide a specific stitch arrangement for connecting the two shoe parts.

Another aspect hereof includes a jig for stitching two shoe parts together on an embroidery machine. The jig includes a curved mounting member capable of being coupled to the embroidery machine. The jig also includes a curved support surface extending from the mounting member and capable of supporting the two shoe parts as they are joined together. The curved support surface includes an edge located at a location distal from the mounting member and that has the general shape of the stitch line to be formed between the two shoe parts.

A further aspect includes a method of joining two shoe parts together in a specific fashion. The method includes providing an embroidery machine with a hat hoop drive mechanism and securing the two shoe parts to a curved jig. The method also includes securing the curved jig to the hat hoop drive mechanism; accessing a pattern from a computing device of the embroidery machine. The pattern represents the stitch line for joining the two shoe parts together. The method also includes joining the two shoe parts together based upon the pattern.

Referring to FIG. 1, a known embroidery machine 10 is described. The embroidery machine 10 has a frame 12 with an upstanding support bracket 16. A stitching head 14 is slidably mounted to an upstanding bracket 16. The head 14 has a needle base 18 mounted on the lower end. The needle base 18 has a plurality of presser foot (including a stitching needle) arrangements 20 which can be selectively engaged by the machine 10. More specifically, the head 14 is slidably mounted to the bracket 16 in such a manner that any one of the presser foot arrangements 20 can be selectively activated. Each of the presser foot arrangements 20 can have a different type or color of thread associated therewith. The different types or colors of threads are supplied to their respective presser foot arrangement 20 by the thread course 22 mounted on the frame 12. The thread course 22 can contain a number of different spools of thread representing different colors or types. The selection of a different presser foot arrangement 20 is accomplished by the head 14 sliding on a rail 24 mounted to the support bracket 16. An actuator (not shown) is used to move the head 14 along the rail 24 in such a manner that a selected foot presser arrangement 20 becomes operational.

The machine 10 further includes a cylinder bed 26 mounted to the frame 12. The cylinder bed 26 includes an aperture 28 that receives the needle of a selected presser foot arrangement 20. The cylinder bed 26 also has an upper surface 30 that contains the aperture 28. A fabric or material being stitched by the machine 10 is pinched between the selected presser foot arrangement 20 and the upper surface 30 so the associated needle can perform a stitching operation.

The known embroidery machine 10 is usually used to embroider a design on a selected fabric, for instance a back pack or clothing item. The machine 10 has typically not been used to actually attach two pieces of material together in a manufacturing process, but has been used to effectuate ornamental designs on a consumer product.

One such known clothing item that is embroidered by the known machine 10 is a baseball cap or hat. Referring to FIG. 1, a special hat hoop drive/positioning mechanism 32 is positioned on the machine 10. The hat positioning mechanism 32 converts the normal horizontal X-Y positioning of the machine 10 into a rotating motion 34 and a linear motion 36 along a Y-axis. More specifically, the machine 10 is typically used to embroider planar items utilizing a jig that is automatically manipulated in the X-Y directions of a horizontal plane to effectuate a pattern on the planar item. As is apparent, a baseball hat is cylindrical in shape and needs a different type of positioning mechanism 32.

The positioning mechanism 32 includes a circular drive frame 38 positioned around the cylinder bed 26 and coupled to an X-axis actuator 40. Without the hat positioning mechanism 32, the actuator 40 is normally used to position a planar item in the horizontal X direction, that is, from left and right across the needle base 18. With the hat positioning mechanism 32 attached, the motion of the actuator 40 is shifted to a rotational motion 34 along the circumference of the drive frame 38. Thus, for instance, a hat could be automatically positioned for embroidery in a circumferential direction by the rotation of the drive frame 38. Still further, the actuator 40 is slidably coupled on both ends 42 to the frame 12 in order to accomplish the linear motion 36 along a horizontal Y-axis, that is back and forth across the needle base 18. A suitable actuator (not shown) is utilized to automatically effectuate linear motion 36. A pair of flanges 48 are also added to the machine 10 when it is set up in its hat embroidery configuration.

The hat positioning mechanism 32 (and therefore the rotational motion 34 of the drive frame 38 and the linear motion 36) along with the stitching head 14 are electronically coupled to and controlled by a computing device 44. The computing device 44 has a monitor 46. In addition to controlling the positioning mechanism 32, the computing device 44 is capable of storing a multitude of stitching/embroidery patterns. For instance, a stored embroidery pattern can be selected utilizing the monitor 46 and the pattern automatically effectuated by the positioning mechanism 32.

One such known embroidery machine that has been found suitable for aspects hereof is the TEMX-C series manufacture by the Tajima Corporation.

Figure 3A:
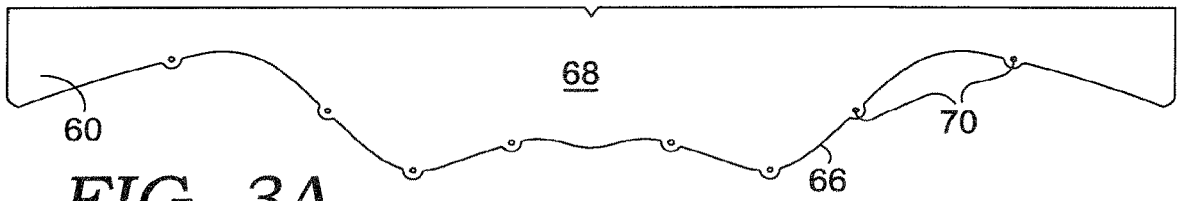
FIG. 3A depicts a top plan view of a pattern for the curved support member of the jig of FIG. 2, in accordance with exemplary aspects hereof.

Referring to FIGS. 2, 3A, 4, 5, and 6, a jig 50 is depicted and is designed to utilize the known embroidery machine 10 and the hat positioning mechanism 32 to stitch together two shoe parts, for instance, but not limited to an exterior upper 52 and a heel liner 54. Normally a hat jig (not shown) with a hat attached thereto is removably attached to the circular drive frame 38. The jig 50 takes the place of the hat jig, but utilizes the same positioning mechanism 32 as the hat jig. The jig 50 includes a circular mounting member 56 for engaging the circular drive frame 38 in a removable manner. More specifically, the mounting member 56 can be mated with the drive frame 38 in such a manner such that mounting member 56 fits snugly around the drive frame 38, so that as drive frame 38 is rotated, so is the mounting member 56. The mounting member 56 can be secured in this manner around the drive frame 38 by any suitable means, for instance a releasable bracket, a pin/slot arrangement, a compression fit, or a bolt arrangement. The important point is that the rotational motion of the drive frame 38 is transferred to the mounting member 56 and thus the jig 50. The mounting member 56 can include segment flanges 58 that can also be used as a mounting surface for mounting to the drive frame 38. It is contemplated that the rotational motion of positioning mechanism 32 could also be applied to segment flanges 58 in any suitable fashion. The jig 50 also includes a curved support member 60 extending at least partially around the circumference of the mounting member 56. More specifically, it may be desirable to have the support member 60 extend up to 270 degrees of the circumference of the mounting member 56. The 270 degrees limit coincides with the maximum rotation that the drive frame 38 is capable of in one type of known embroidery machine 10. Referring to FIG. 3A, a pattern for making a curved support member 60 is depicted. The pattern could represent the actual support member 60 before it is curved to attach it to the circumference of the mounting member 56. Still further, the pattern can represent the layout for the support member 60 that is integrally formed with the mounting member 56. The support member 60 includes an elongated wavy edge 66 formed at the distal end farthest away from the mounting member 56. As will be more fully described herein, the edge 66 coincides with the stitch pattern that will be used to join the external upper 52 and the heel liner 54. It is along the edge 66 that a needle of a selected presser foot arrangement 20 passes so as to engage the aperture 28 of the cylinder bed 26. Thus, when the two shoe parts are attached to the jig 50 as will be described herein, the actual stitching of the machine 10 will take place along the edge 66. The curved support member 60 has a curved outer surface 68 for supporting the upper 52 and the liner 54 as will be further described herein.

Figure 8:
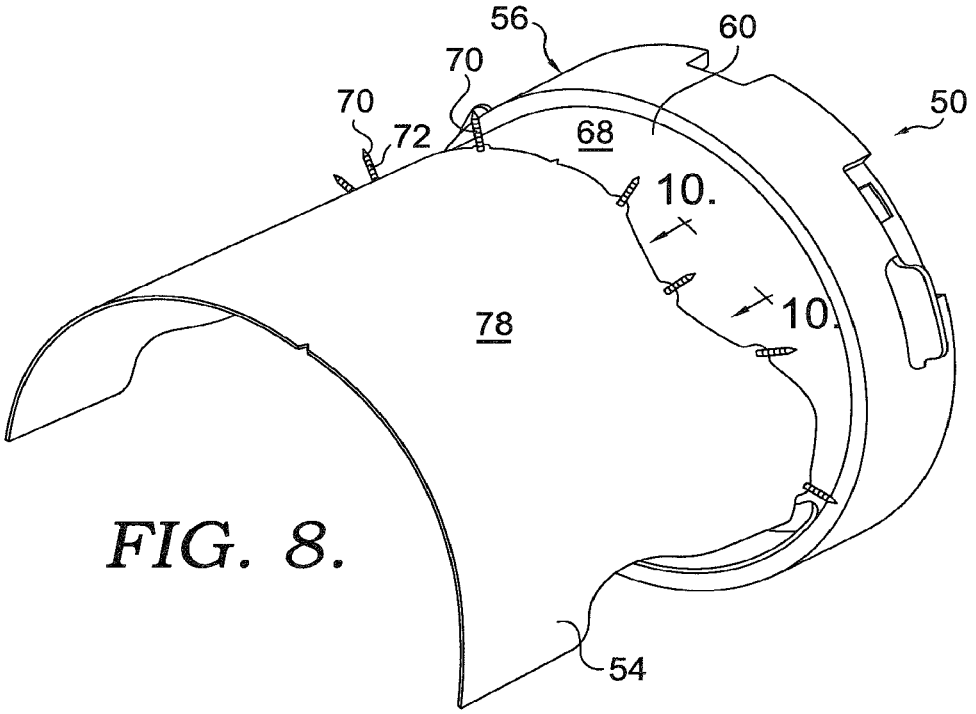
FIG. 8 depicts a top plan view of the jig of FIG. 6 showing the completed positioning of a heel liner part on the jig, in accordance with exemplary aspects hereof.
Figure 10:
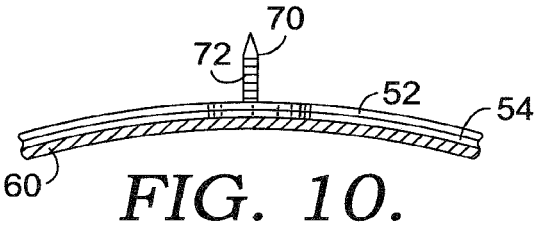
FIG. 10 depicts a cross sectional view taken along lines 10-10 of FIG. 8, in accordance with exemplary aspects hereof.
Figure 9:
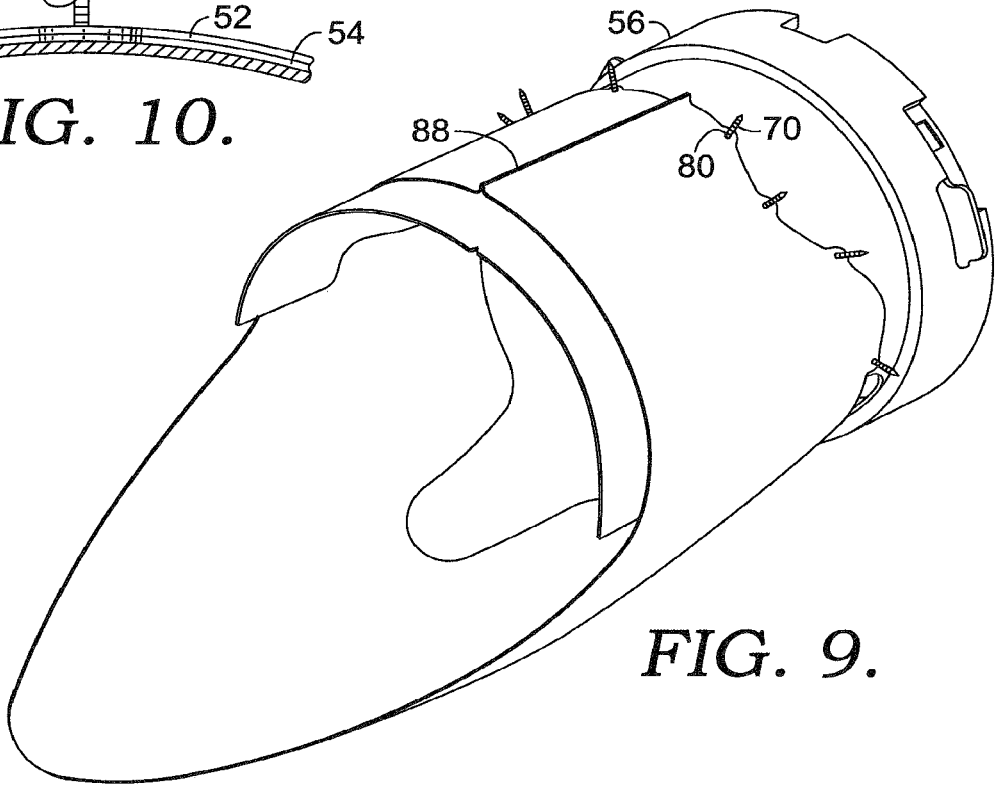
FIG. 9 depicts a top plan view of the jig of FIG. 6 showing the completed positioning of the exterior upper part on the jug, in accordance with exemplary aspects hereof.

The curved support member 60 also has attachment pins 70 extending upwardly from the curved outer surface 68. The pins 70 will be used to secure the upper 52 and the liner 54 to the jig 50. The pins 70 are positioned along the edge 66. Referring to FIGS. 8-10, the pins 70 can have a threaded surface 72 formed thereon for holding the shoe part thereon. The surface 72 can be any suitable arrangement that operates to hold a shoe part thereon through friction, for instance a barbed or roughed surface. As will be more fully described herein, when the upper 52 and the liner 54 are position on the pins 70, the edge 66 will be covered by the portions of both the upper 52 and the liner 54 that are to be connected together.

The jig 50 can be made of a one piece construction, such that the circular mounting member 56, the curved support member 60 and the pins 70 are all integrally formed together. Still further, the jig 50 could be made of separate components (i.e. the circular mounting member 56, the curved support member 60 and the pins 70) that are then attached together in any suitable manner, for instance welding, adhesive or rivets. The jig can be made of a suitable material, for instance metal, plastic or fiberglass or any combination thereof.

Figure 5:
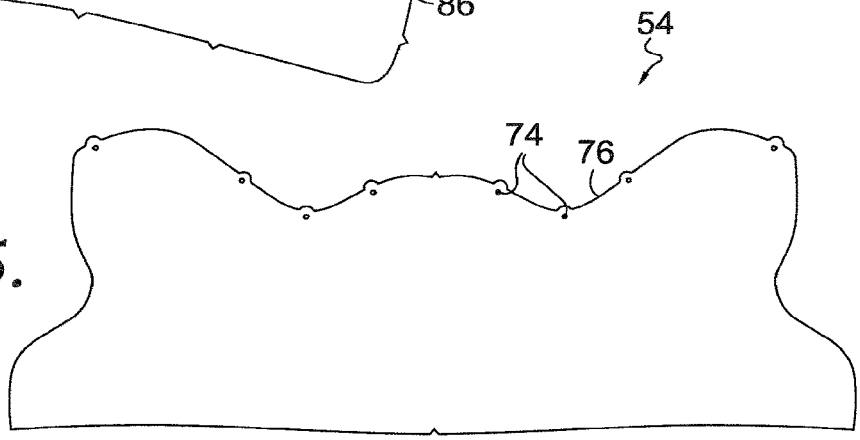
FIG. 5 depicts a top plane view of a shoe upper component in the form of a heel liner part, in accordance with exemplary aspects hereof.
Figure 6:
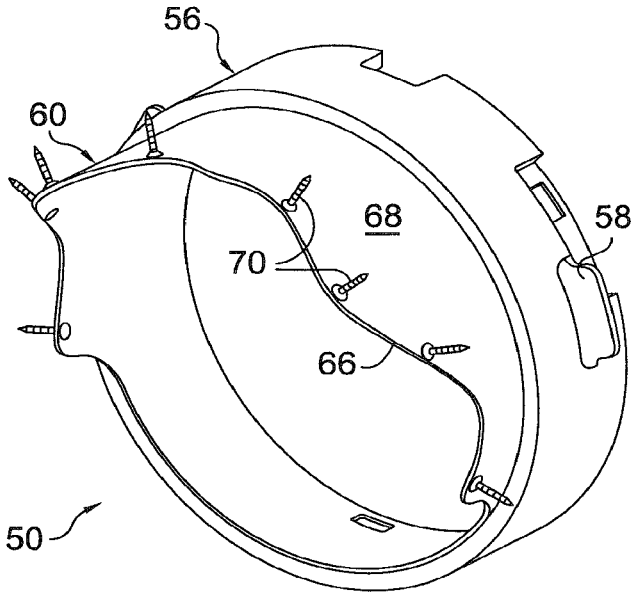
FIG. 6 depicts a top plan view of the jig of FIG. 2 removed from the hat hoop positioning mechanism of the embroidery machine, in accordance with exemplary aspects hereof.
Figure 7:
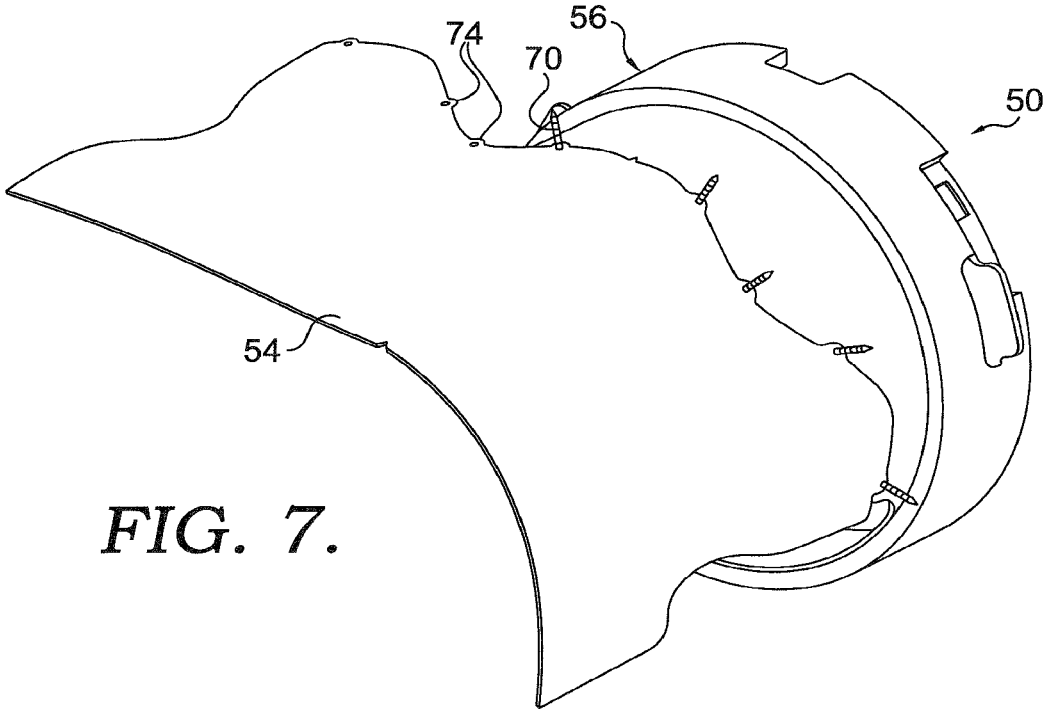
FIG. 7 depicts a top plan view of the jig of FIG. 6 showing the partial positioning of a heel liner part on the jig, in accordance with exemplary aspects hereof.

Referring to FIGS. 5, 7 and 8, the heel liner 5 has a series of mounting apertures 74 that are configured to receive the pins 70 of the jig 50. More specifically, the liner 52, when it is cut out from a larger piece of material, is fabricated to include the apertures 74 along an edge 76 that eventually, when joined with the upper 52, will become a portion of the collar of a resulting shoe upper, as will be more fully described herein. Referring to FIG. 7, the heel liner 54 is shown partially attached to the jig 50 in that five of the pins 70 are engaging five of the apertures 74. The heel liner 54 is symmetrical and thus in FIG. 7, a little more than one half of the heel liner portion of the resulting collar is secured to the jig 50. Referring to FIG. 8, the heel liner 54 is depicted with all of its apertures 74 engaging the pins 70 such that it is fully attached to the jig 50. The heel liner 54 and the exterior upper 52 are stitched together in an inside out arrangement such that when they are turned right-side out, the seam connecting them is obscured and on the inside of the arrangement. Thus, when the heel liner 54 is placed on the jig 50 the surface 78 that will be facing the wearer's foot will be furthest away from the curved outer surface 68.

Figure 4:
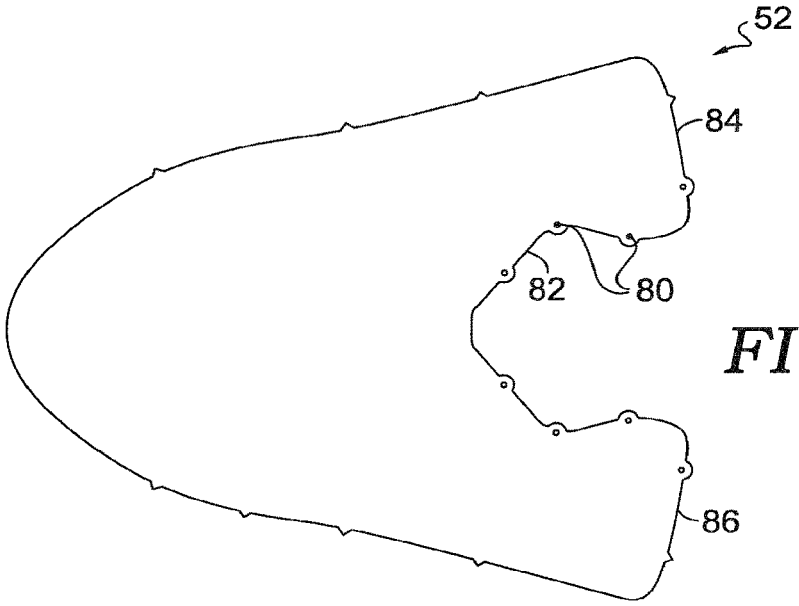
FIG. 4 depicts a top plan view of a shoe upper component in the form of an exterior upper part, in accordance with exemplary aspects hereof.

Referring to FIGS. 4, 9 and 10, the exterior upper 52 has a series of mounting apertures 80 that are configured to receive the pins 70 of the jig 50. More specifically, the upper 52, when it is cut out from a larger piece of material, is fabricated to include the apertures 80 along an edge 82 that eventually, when joined with the liner 54, will become a portion of the collar of a resulting shoe upper, as will be more fully described herein. Referring to FIG. 4, prior to the upper 52 being positioned on the jig 50, the back edges 84 and 86 may be joined in any suitable stitching action. By connecting the edges 84 and 86, the very back seam of a resulting shoe upper is formed. The back edges 84 and 86 can be stitched together by simply folding one half of the external upper 52 onto the other half and stitching the edges 84 and 86 together. This is possible because the external upper 52 is approximately symmetrical. When the back edges 84 and 86 are connected, the external upper 52 is inside out such that if it was turned right-side out, a connecting seam 88 would be hidden inside the shoe. The joining of the back edges 84 and 86 is the operation that creates the collar arrangement of a resulting shoe. Referring to FIG. 9, the upper 52 is depicted with all of its apertures 80 engaging the pins 70 such that it is fully attached to the jig 50. The upper 52 is positioned on top of the liner 54 on the jig 50. The upper 52 and the liner 54 utilize the same pins 70 for attachment to the jig 50. The upper 52 with the back edges 84 and 86 connected is the configuration that is placed on the jig 50. Thus, the collar edge 82 of the upper 52 forms a closed circle. It is this closed circle arrangement that requires the curved nature of the jig 50 and allows the closed collar edge 82 to in essence fit around the curved support member 60 of the jig 50. The closed collar upper 52 is positioned on the jig 50 in an inside out fashion such that once the closed collar edge 82 of the upper 52 is stitched to the collar edge 76 of the liner 54, the entire structure will need to be turned right-side out to hide the stitching between the upper 52 and the liner 54.

Figure 11:
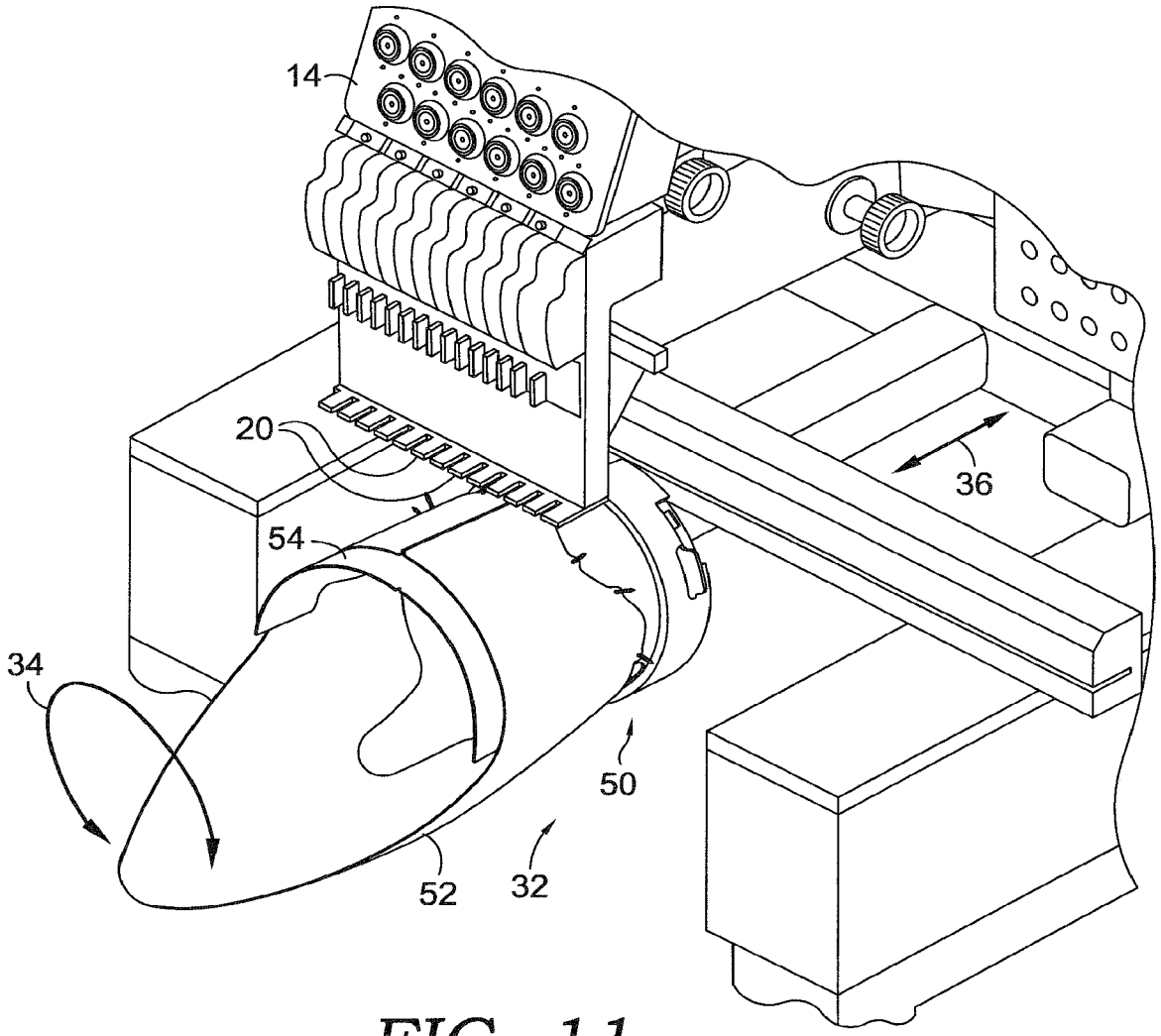
FIG. 11 depicts a top perspective view of the system of FIG. 2 showing the stitching operation joining the shoe exterior upper part to the heel liner part, in accordance with exemplary aspects hereof.
Figure 14:
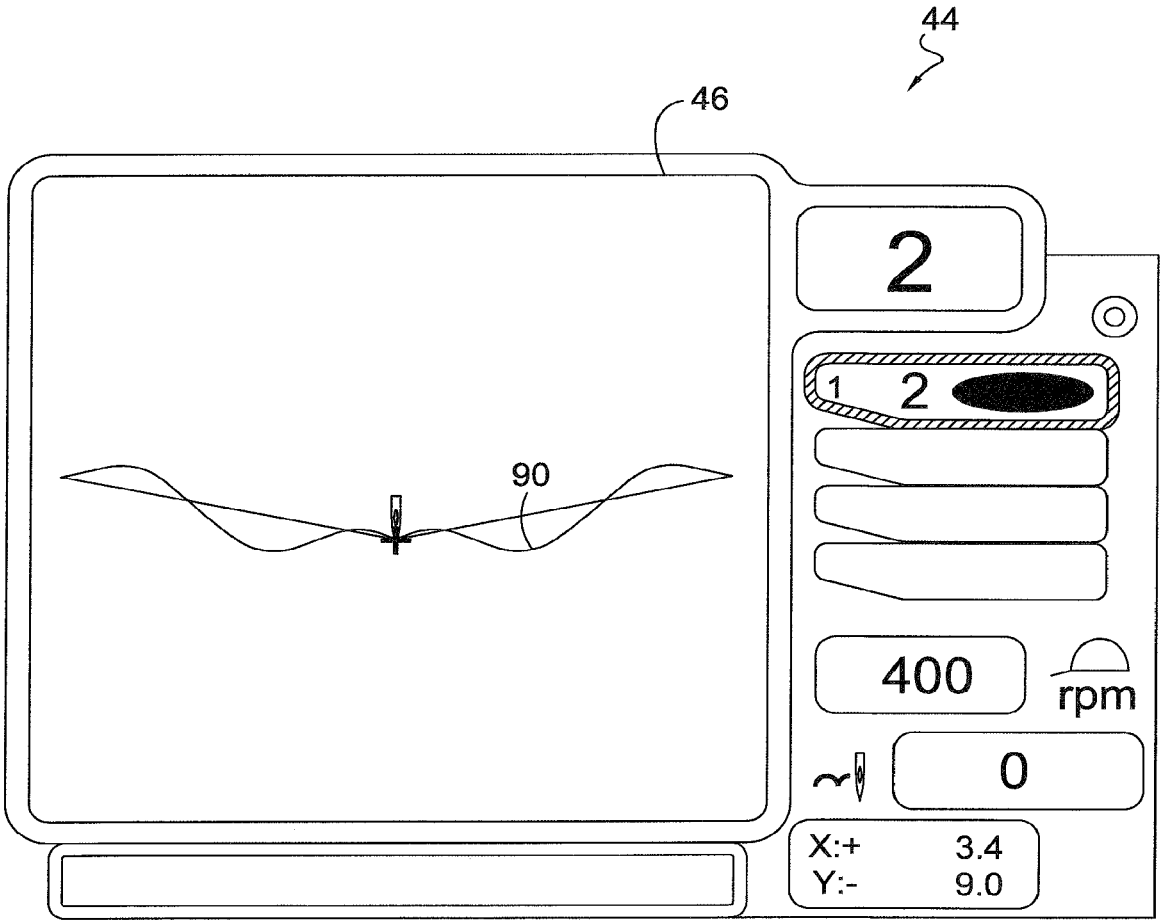
FIG. 14 depicts a computer monitor of the system of FIG. 2 showing a selected stitch pattern.

Referring to FIGS. 11 and 14, the stitching operation after the external upper 52 and the heel liner 54 have been secured to the jig 50 will be described. It is contemplated that the upper 52 and the liner 54 will be attached to the jig 50 while the jig 50 is removed from the positioning mechanism 32. Thereafter, the jig 50 with the parts attached thereto can be coupled to the positioning mechanism 32. It is also contemplated that the upper 52 and the liner 54 can be attached to the jig 50 while the jig 50 is attached to the positioning mechanism 32. A stitch pattern 90 is selected from the computing device 44. As described herein, there can be multiple patterns stored in the computing device 44. The pattern 90 coincides with the final stitch line for connecting the upper 52 to the liner 54 to create the collar of a resulting shoe. The pattern 90 also generally has the path/shape of the wavy edge 66 of the jig 50. The pattern 90 controls the automated stitching operation of the machine 10. Once the pattern 90 is selected, the computing device 44 is activated such that the selected presser foot arrangement 20 will automatically be positioned at the center of the edge 66. The computing device 44 can also be set to start the stitching operation at any point along the pattern 90, for instance one end or the other. The offset in relation to the edge 66 may also be set manually on the computing device 44. This operation determines manually how far from the edge 66 to start stitching the pattern 90. Once an offset is manually set, the computing device 44 will remember the offset for future operations. Referring to FIG. 11, the machine is shown automatically stitching the upper 52 and the liner 54 together. More specifically, the positioning mechanism 32 is actuated to move the jig 50 in rotational motion 34 and in linear motion 36 so that a selected and activated foot presser arrangement 20 follows the pattern 90. After completion of the stitching operation, the jig 50 can be removed from the positioning mechanism 32. The combined upper 52 and liner 54 can be removed from the jig 50 by removing their respective apertures 74 and 80 from the pins 70. The combined upper 52 and the liner 54 can then be turned right-side out to hide both the connecting seam 88 and the resulting collar seam.

As is apparent, the system herein provides an automated manner of intricately connecting two shoe parts without significant human interaction. This is far from the traditional manual stitching operations that are very labor intensive and provide inconsistent results. The use of an electronically stored pattern ensures consistent manufacturing time after time. Efficiencies of manufacture are also greatly enhanced.

Figure 3B:
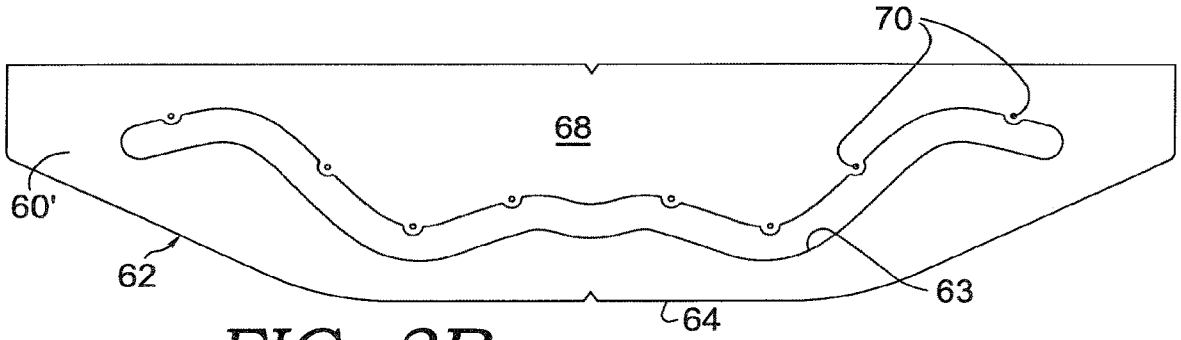
FIG. 3B depicts a top plan view of a pattern an alternative curved support member, in accordance with exemplary aspects hereof.

Referring to FIG. 3B, another aspect hereof includes an alternative pattern for making a curved support member 60'. The pattern could represent the actual support member 60' before it is curved to attach it to the circumference of the mounting member 56. Still further, the pattern can represent the layout for the support member 60' that is integrally formed with the mounting member 56. The curved support member 60' includes a distal edge 62 that is farthest away from the mounting member 56 and that tapers to a flat area 64. The support member 60' also includes an elongated wavy aperture 63 formed therein. The aperture 63 coincides with the stitch pattern that will be used to join the external upper 52 and the heel liner 54. In this additional aspect, a needle of a selected presser foot arrangement 20 passes through aperture 63 so as to engage the aperture 28 of the cylinder bed 26. Thus, when the two shoe parts are attached to the jig 50 as described herein, the actual stitching of the machine 10 will take place within the confines of aperture 63.

Figure 16:
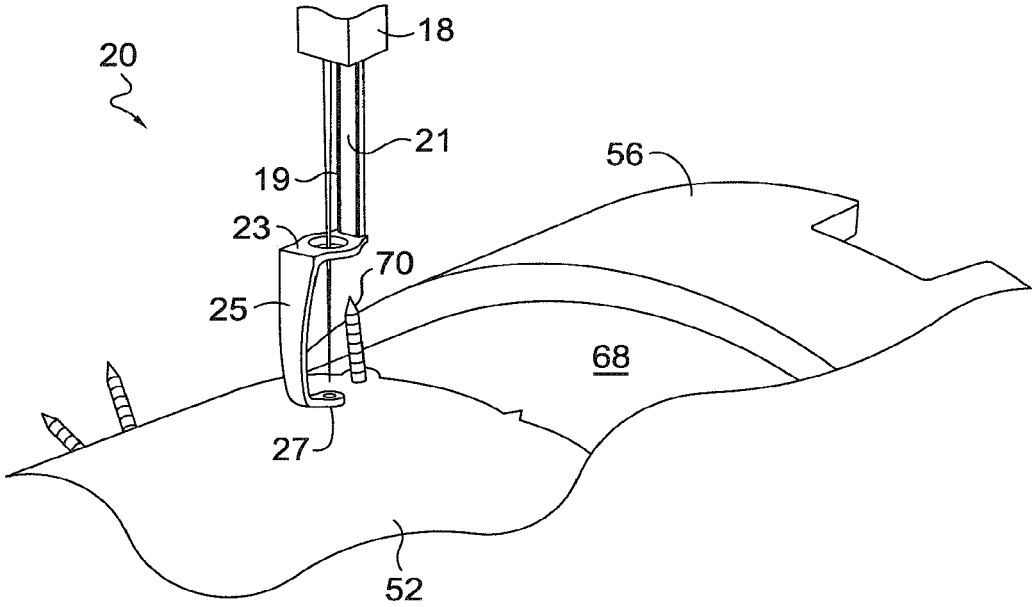
FIG. 16 depicts a top perspective view of a presser foot arrangement of FIG. 2 showing its orientation in relation to an exemplary pin member, in accordance with exemplary aspects hereof.

Referring to FIG. 16, the details of the presser foot arrangement 20 are depicted. The arrangement 20 includes a needle 19 for performing the stitching operations. The arrangement 20 also includes a vertical member 21 mounted to the needle base 18. The vertical member 21 includes a crossover member 23 with an aperture therein for receiving the needle 19 and a vertical extension member 25 having a foot 27 disposed thereon. The foot 27 also has an aperture for receiving the needle 19. The upper 52 and the liner 54 are pinched or clamped between the foot 27 and the cylinder bed 26 during the stitching operation. The provision of the extension member 25 opposite to the mounting member 56 of the jig 50, and thus also away from the pins 70, ensures unobstructed operation of the presser foot arrangement 20. More specifically, if the vertical member 21 and the vertical extension member 25 are on the same side of a stitch line as are the pins 70, there is interference with the stitching operation. The crossover member 23 ensures that there is not interference.

Figure 12:
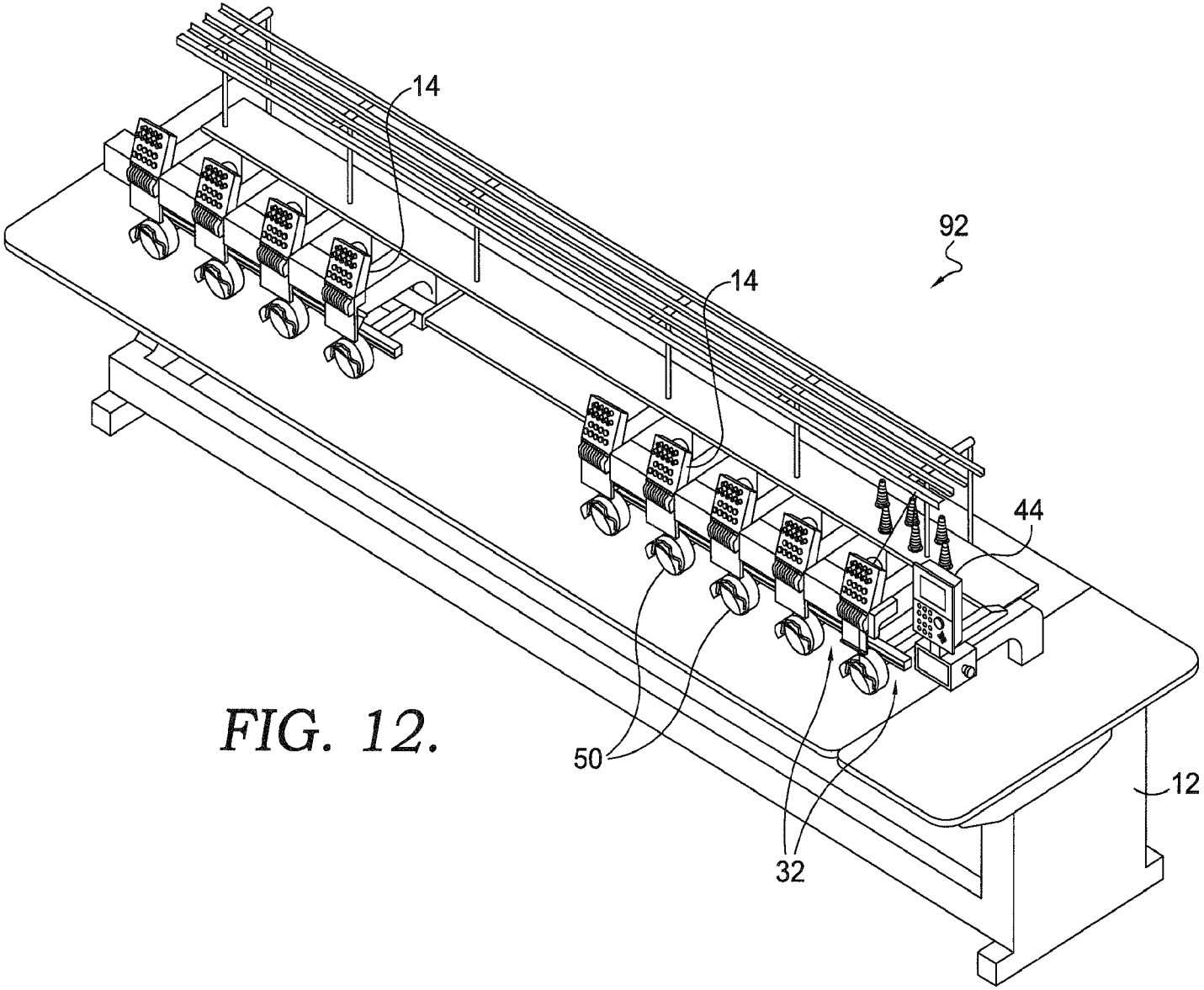
FIG. 12 depicts a top perspective view similar to FIG. 2, but showing a multi head system with each head having a jig and a positioning mechanism associated therewith, in accordance with exemplary aspects hereof.

Referring to FIG. 12, another aspect hereof includes a multi headed embroidery machine 92 with a plurality of stitching heads 14, a plurality of positioning mechanisms 32 and a plurality of jigs 50. Each of heads 14 and positioning mechanisms 32 are controlled by a computing device 44 so that multiple pairs of the uppers and the liners 54 can be combined in one operation. Thus, the machine 92 increases significantly the through put of the operation because of the multiple heads 14. As is apparent, although a combination of an external upper 52 and a heel liner 54 is described, the systems, methods and apparatuses described herein could apply to any two shoe parts.

Figure 13:
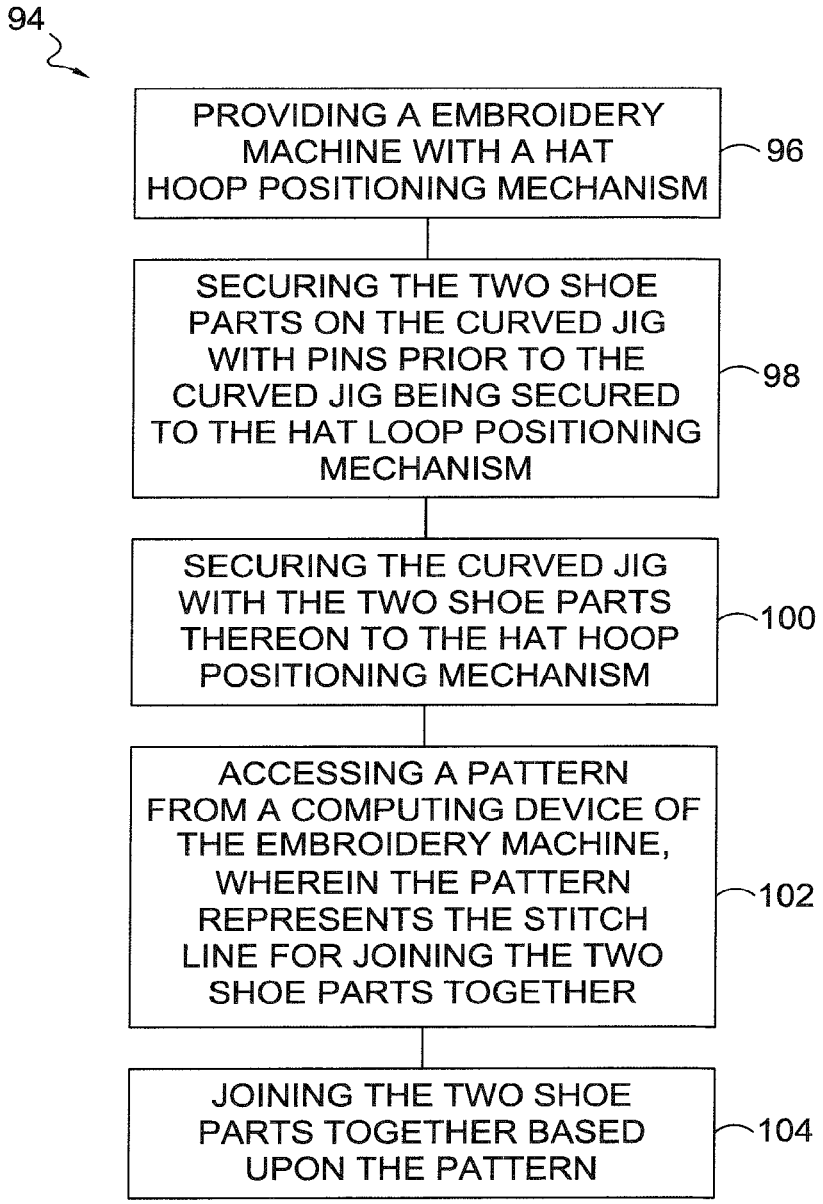
FIG. 13 depicts a flow diagram representing a method for joining two shoe parts in a specific fashion, in accordance with exemplary aspects hereof.

FIG. 13 depicts a flow diagram representing a method 94 for joining two shoe parts together in a specific manner. It is contemplated that while a specific order of steps is presented and discussed that alternative ordering may be implemented without departing from the scope of the aspects provided herein. At a first block 96, a step represents providing an embroidery machine with a hat hoop positioning mechanism. At block 98, a step represents securing the two shoe parts to a curved jig. At block 100, a step represents securing the curved jig to the hat hoop positioning mechanism. At block 102, a step represents accessing a pattern from a computing device of the embroidery machine. The pattern accessed represents the stitch line for joining the two shoe parts together. At block 104, a step represents joining the two shoe parts together based upon the pattern.

Figure 15:
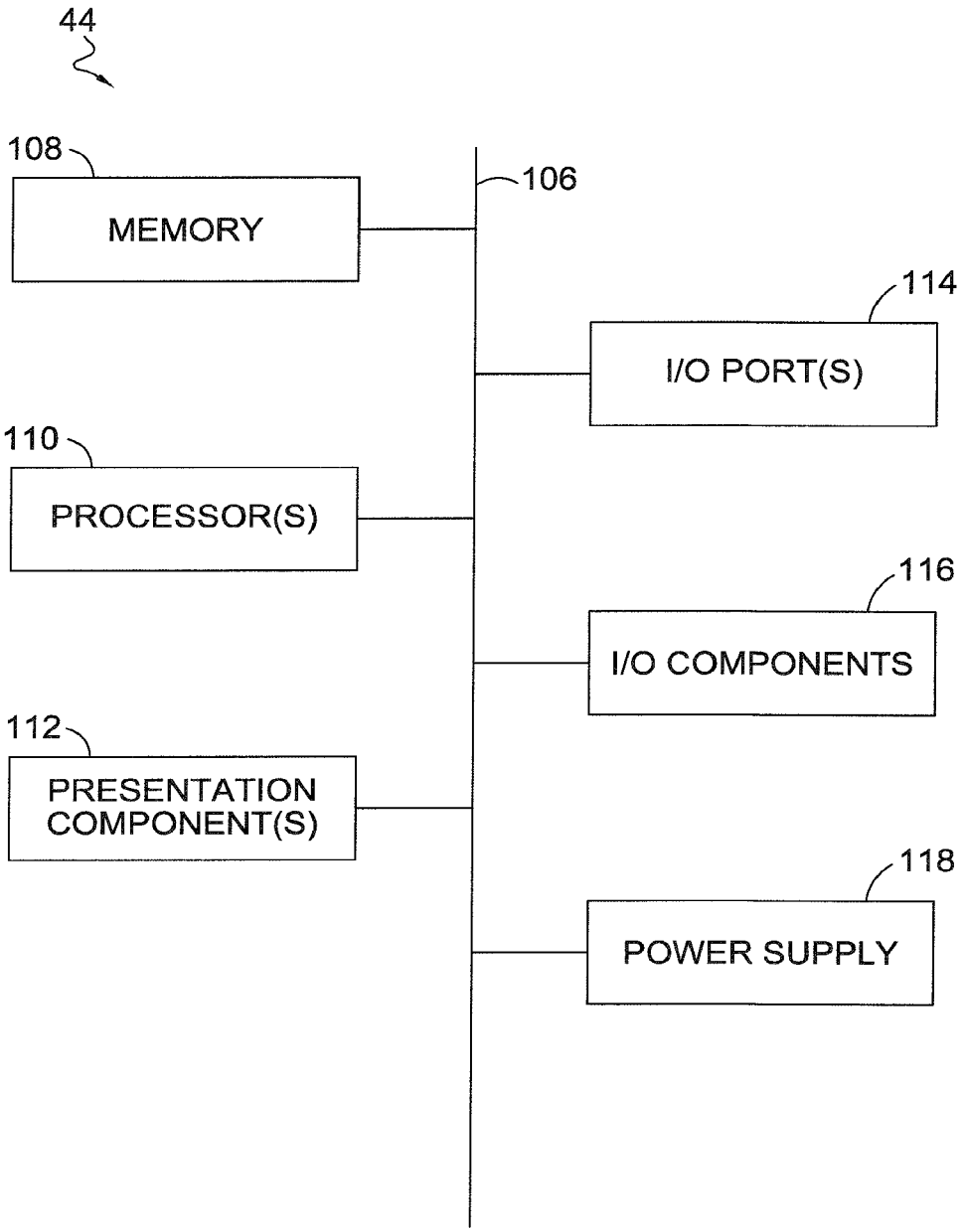
FIG. 15 depicts an exemplary computing operating environment, such as a programmable logic controller and/or a personal computer, for implementing aspects of the invention hereof.

FIG. 15 depicts an exemplary computing operating environment for implementing aspects hereof as shown and designated generally as computing system or device 44. For example, aspects provided herein contemplate using a computing device 44 to store stitch patterns 90, to control the positioning mechanism 32, and to actuate stitching head 14 so as to automatically stitch two shoe parts together. The computing device 44 is but one example of a suitable computing environment and is not intended to suggest any limitation as to the scope of use or functionality of the invention. Neither should the computing device 44 be interpreted as having any dependency or requirement relating to any one or combination of components illustrated.

Aspects hereof may be described in the general context of computer code or machine-useable instructions, including computer-executable instructions such as program components, being executed by a computer or other machine, such as a programmable logic controller ("PLC"). Generally, program components, including routines, programs, objects, components, data structures, and the like, refer to code that performs particular tasks or implements particular abstract data types. Aspects hereof may be practiced in a variety of system configurations, including handheld devices, consumer electronics, general-purpose computers, personal computers, specialty computing devices, PLC, etc. Aspects hereof may also be practiced in distributed computing environments where tasks are performed by remote-processing devices that are linked through a communications network.

With continued reference to FIG. 15, computing device 44 includes a bus 106 that directly or indirectly couples the following devices: memory 108, one or more processors 110, one or more presentation components 112, input/output (I/O) ports 114, I/O components 116, and an illustrative power supply 118. The bus 106 represents what may be one or more busses (such as an address bus, data bus, or combination thereof). Although the various blocks of FIG. 15 are shown with lines for the sake of clarity, in reality, delineating various components is not so clear, and metaphorically, the lines would more accurately be grey and fuzzy. For example, one may consider a presentation component such as a display device to be an I/O component 116. Also, processors have memory. It is recognized that such is the nature of the art, and reiterated that the diagram of FIG. 15 is merely illustrative of an exemplary computing device that can be used in connection with one or more aspects hereof. Distinction is not made between such categories as "workstation," "server," "laptop," "handheld device," "tablet," "phone," "node," "PLC," etc., as all are contemplated within the scope of FIG. 15 and refer to "computer" or "computing device." In particular, aspects hereof are contemplated as being performed in whole or in part on one or more components of a distributed computing system. It is contemplated that a distributed computing system may be comprised of processors, networks, and memory that scale to handle a desired level of computing processes at a time. Therefore, it is contemplated that a computing device may also refer to the computing environment of a distributed computing system that dynamically changes with time and/or demand.

Computing device 44 typically includes a variety of computer-readable media. Computer-readable media can be any available media that can be accessed by computing device 44 and includes both volatile and nonvolatile media, removable and non-removable media. By way of example, and not limitation, computer-readable media may comprise computer-storage media and communication media. Computer-storage media includes both volatile and nonvolatile, removable and non-removable media implemented in any method or technology for storage of information such as computer-readable instructions, data structures, program modules or other data.

Computer-storage media includes RAM, ROM, EEPROM, flash memory or other memory technology, CD-ROM, digital versatile disks (DVD) or other optical disk storage, magnetic cassettes, magnetic tape, magnetic disk storage or other magnetic storage devices. Computer storage media does not comprise a propagated data signal.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 108 includes computer-storage media in the form of volatile and/or nonvolatile memory. The memory 108 may be removable, nonremovable, or a combination thereof. Exemplary memory includes non-transitory, solid-state memory, hard drives, optical-disc drives, etc. Computing device 44 includes one or more processors 110 that read data from various entities such as bus 106, memory 108 or I/O components 116. Presentation component(s) 112 present data indications to a person or other device. Exemplary presentation components 112 include a display device, speaker, printing component, vibrating component, etc. I/O ports 114 allow computing device 44 to be logically coupled to other devices including I/O components 116, some of which may be built in. Illustrative I/O components 116 include a microphone, joystick, game pad, satellite dish, scanner, printer, wireless device, etc.

The invention claimed is:

1. A stitching system for stitching two parts of a shoe together comprising:

a stitching machine including a head and a cylinder bed, wherein the head has a needle base disposed on a lower end adjacent the cylinder bed such that the two shoe parts can be stitched together therebetween;

a positioning mechanism having a curved drive frame coupled thereto, wherein the positioning mechanism is capable of moving the curved drive frame in a rotating motion along a circumference of the curved drive frame and in a linear direction generally along an axis of the curved drive frame;

a jig for positioning the two shoe parts with respect to one another and coupled to the curved drive frame, wherein the jig includes a curved support surface for two shoe parts and at least one pin extending upwardly from the curved support surface; and a computing device for controlling actuation of the needle base and the positioning mechanism such that the jig can be manipulated to provide a specific stitch arrangement for connecting the two shoe parts.

2. The stitching system of claim 1 wherein the stitching machine is an embroidery machine.

3. The stitching system of claim 1 wherein the stitching machine has multiple pairs of heads with needle bases and cylinder beds, wherein each pair is associated with its own curved drive frame such that multiple jigs can be used to stitch multiple pairs of shoe parts together at one time.

4. The stitching system of claim 1 wherein the curved support surface of the jig has an edge that is at a location that is distal from the curved drive frame and that has the general shape of a stitch line used to connect the two shoe parts together.

5. The stitching system of claim 1, wherein at least one of the shoe parts has at least one preformed aperture for engaging the at least one pin.

6. The stitching system of claim 5, wherein the two shoe parts include an exterior shoe upper and a heel liner.

7. The stitching system of claim 6, wherein both the exterior shoe upper and the heel liner are attached to multiple pins formed on the curved support surface of the jig.

8. The stitching system of claim 7, wherein a stitch line between the exterior shoe upper and the heel liner is along a collar of a resulting shoe.

9. The stitching system of claim 1, wherein the curved drive frame is a cylinder and the jig includes a cylindrical mounting member for removably mounting the jig to the curved drive frame, and wherein the cylindrical mounting member and the curved support surface are integrally formed.

10. A jig for stitching two shoe parts together on an embroidery machine, the jig comprising:

a curved mounting member capable of being coupled to the embroidery machine;

a curved support surface extending from the curved mounting member and capable of supporting the two shoe parts as they are joined together, wherein the curved support surface includes an edge that is at a location distal from the curved mounting member and that has the general shape of a stitch line to be formed between the two shoe parts; and at least one pin extending upwardly from the curved support surface.

11. The jig of claim 10, wherein the at least one pin comprises a plurality of pins positioned adjacent to and spaced along the distal edge of the curved support surface.

12. The jig of claim 10, wherein the curved mounting member is cylindrical in shape and is capable of being removably mounted on the embroidery machine, and wherein the curved mounting member and the curved support surface are integrally formed.

13. The jig of claim 10, wherein a first of the shoe parts is an exterior upper and a second of the shoe parts is a heel liner, and wherein a stitch line of the two shoe parts follows a collar of a resulting shoe.

14. A method of joining two shoe parts together in a specific fashion, the method comprising:

providing an embroidery machine with a hat hoop positioning mechanism;

securing the two shoe parts to a curved jig by securing the two shoe parts to at least one pin extending upwardly from a curved surface of the curved jig;

securing the curved jig to the hat hoop positioning mechanism;

accessing a pattern from a computing device of the embroidery machine, wherein the pattern represents a stitch line for joining the two shoe parts together; and joining the two shoe parts together based upon the pattern.

15. The method of claim 14 further comprising providing an edge in the curved jig that is the general shape of the stitch line.

16. The method of claim 14, wherein securing the two shoe parts to at least one pin comprises securing the two shoe parts on the curved jig to a plurality of pins prior to the curved jig being secured to the hat hoop positioning mechanism.

17. The method of claim 16 further comprising forming apertures in at least one of the shoe parts so that the apertures can receive the plurality of pins.

18. The method of claim 14 wherein the embroidery machine includes multiple stitching heads and further comprising:

securing multiple curved jigs to multiple hat loop positioning mechanisms; and joining multiple pairs of shoe parts based upon the pattern accessed.

* * * * *